United States Patent [19]

Allison et al.

[11] Patent Number: 4,688,276

[45] Date of Patent: Aug. 25, 1987

[54] EMERGENCY EYE WASH FOUNTAIN

[76] Inventors: Gary D. Allison; Michele Allison, both of 13650 Santa Ysabel, Desert Hot Springs, Calif. 92240

[21] Appl. No.: 836,828

[22] Filed: Mar. 6, 1986

[51] Int. Cl.[4] ..... A61H 33/04

[52] U.S. Cl. ..... 4/620

[58] Field of Search ..... 4/620, 621, 623, 624; 239/28, 31, 540.3; 604/294

[56] References Cited

U.S. PATENT DOCUMENTS

| | | | |
|---|---|---|---|
| 2,482,960 | 9/1949 | Benson | 4/620 |
| 3,925,829 | 12/1975 | Bost | 4/620 |
| 4,151,955 | 5/1979 | Stouffer | 239/540 |

*Primary Examiner*—Stephen Marcus

*Assistant Examiner*—L. J. Peters

*Attorney, Agent, or Firm*—I. Louis Wolk

[57] ABSTRACT

An eye wash fountain device in which eye wash nozzles are attached to a unit which is separate from and removably attached to a conduit on an adapter for attachment to water supply, the adapter being provided with a valve to divert normal water flow to the conduit and to the nozzles. The conduit and the nozzles being positioned rearwardly of the water supply in order to project a spray from a position behind the water supply, to protect a user against direct contact with the nozzles.

The flow of water to the nozzles is controllled by a restriction in the conduit leading from the adapter and the spray from the nozzles is modified by the insertion of a plurality of steel balls adjacent the nozzle exits.

2 Claims, 5 Drawing Figures

EMERGENCY EYE WASH FOUNTAIN

SUMMARY OF THE INVENTION

In accordance with the present invention an assembly is provided which permits almost any sink faucet to be converted to an eye wash station in a very simple manner without interfering with normal faucet operation.

As described below a pair of eye wash nozzles are mounted upon a unit which is separate from and removably attached to a conduit on an adapter which comprises a valve body which permits normal water flow through inlet and exit means when attached to a sink faucet or other water supply.

A valve member positioned within said adapter can quickly divert water flow into the conduit to which the eye wash nozzle unit is attached. The provision of a separate and separable unit for the eye wash nozzles permits application to and removal from the water supply without the necessity of removing the adapter which can remain in place permanently if so desired. The nozzle unit can then be cleaned and stored for use when desired or may remain in attached position.

The adapter unit is designed to project rearwardly from the faucet exit and the eye wash nozzles which are mounted upon the separate attachable unit are so designed that they are positioned to the rear of the downspout of the faucet and at the same time project upwardly at a desired angle so that in use the head and eyes of the user cannot accidentally or inadvertently come in contact with said nozzles. In such arrangement the faucet downspout would prevent such contact as further described below.

As further described herein a valve body is provided with a threaded inlet attachable to a standard faucet. The valve body is provided with a pull out knob which is spring loaded to keep a valve in closed position during normal water flow but when pulled out during water flow the flow is diverted to a separate conduit to which a spray nozzle assembly is removably attached as described further below. When the pull out knob is activated while the water flow is on, water pressure holds the spring loaded valve open leaving the hands free, and the water flows into a pair of spaced apart anti-splash aerator type nozzles angled toward the face and positioned behind the faucet downspout as a protection to the user.

BACKGROUND OF THE INVENTION

This invention relates to an emergency eye wash fountain assembly which can be attached to a conventional sink faucet. Such fountains which comprise a pair of flushing nozzles are in common use in laboratories and factories, and any work areas where there is any risk of eye damage due to the presence of corrosive or irritating materials. Such fountains are usually legal requirements for employee safety in such establishments.

Various types of eye fountains are known and in general use. For example, an attachable apparatus is described in U.S. Pat. No. 3,925,829. Separate fountains with integral spray nozzles are shown in U.S. Pat. Nos. 3,599,251, 3,629,876 and 3,413,660.

DESCRIPTION OF THE PREFERRED EMBODIMENTS

Figure 2:
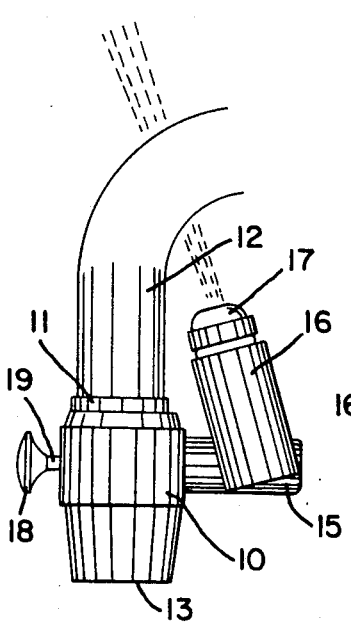
FIG. 2 is a side view in perspective of the assembly of FIG. 1.
Figure 1:
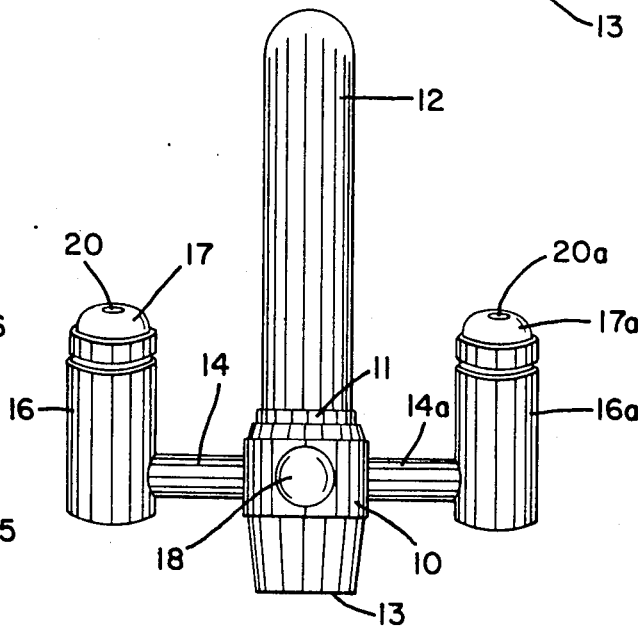
FIG. 1 is a front view in perspective of the assembly mounted upon a faucet.

Referring now to FIGS. 1 and 2 which show front and side elevational views of the assembled device, valve body 10 is shown with its vertically threaded end 11 attached to faucet downspout 12 and with its normal water flow outlet 13. A pair of tubular arms 14 and **14*a* extending outward are attached to opposite sides of a sleeve 15 which is closed at one end and with its open end is designed to slide over and be attached to a conduit mounted upon the valve body as described below with reference to FIGS. 3 and 4**.

Tubular arms 14 and **14*a* are attached to and communicate with a pair of upwardly extending tubular conduit members 16 and 16*a* at the ends of which are attached a pair of spray nozzles 17 and 17*a*. These tubular members relatively short and are attached in an angular position with respect to arms 14 and 14*a* and sleeve 15 so that a spray will be directed at an angle to a user as shown for example in FIG. 2. As shown also in FIG. 2, the dimensions of the sleeve 15 and conduits 16 and 16*a* are selected so that the nozzles 17 and 17*a* will be behind the downspout 12** thus preventing possible direct contact of eyes of a user with the nozzles or at least preventing too close contact with the spray.

Water flow to the nozzles is controlled by means of a pull out knob 18 mounted on shaft 19, and as described further below when knob 18 is pulled out, water flow is diverted from the faucet to the nozzles and the spray exits through the opening 20 thereof.

Figure 3:
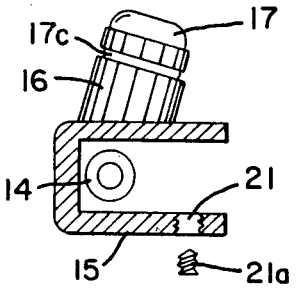
FIG. 3 is a view partially in cross section showing a side view of a nozzle tube attached to a sleeve member as it is positioned for attachment to the eye wash conduit shown in FIG. 4.

In FIG. 3, conduit 16 with nozzle 17 is shown attached at one side to arm 14 and to sleeve 15 (also shown in FIG. 2), said tube 14 communicating with the interior of the sleeve as shown. The sleeve is then designed to snugly fit and slide over a corresponding male conduit on the valve body as described with reference to FIG. 4 and to be secured by means of a set screw **21*a* which is screwed into threaded opening 21 upon attachment as described below. In so attaching the sleeve, it is positioned over conduit 22 of FIG. 4 for a distance such that water flow into tubular arms 14 and 14*a*** is unrestricted.

Figure 4:
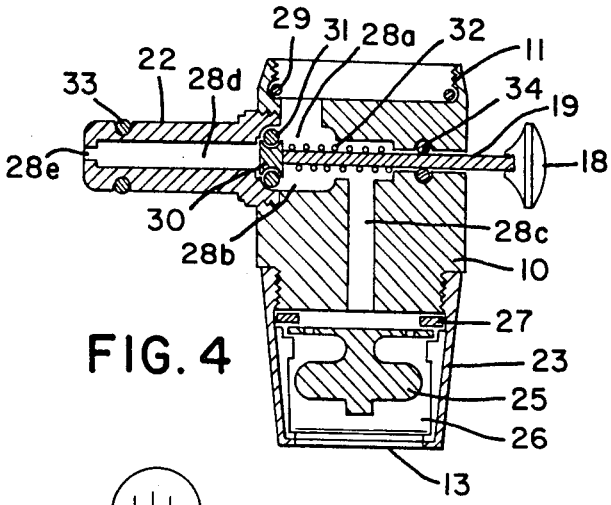
FIG. 4 is a view in vertical transverse cross section of the valve body and nozzle attachment structure which is designed to be attached to a faucet.

As shown in FIG. 4, Valve body 10 is shown with its threaded water inlet opening 11 attachable to the downspout of a faucet. The normal water outlet 13 may have a flow distributor in the form of a housing 23 attached by threads to the valve body and containing, if desired, a perforated water flow distributing member 25 supported within a plastic sleeve 26 and provided with a gasket 27. The valve body as shown is provided with a water inlet 28, gasket 29 and water flow channels or chambers **28*a*, 28*b* and 28*c* through which water flows when the faucet is used for normal flow. Chamber 28*b* is provided with a valve head 30 having an "0" ring 31** thereon designed to seat against the interior of chamber 28*b* and against the opening to conduit 22 to normally close off channel 28*d*, as shown. The valve member is attached to valve stem 19 which is surrounded by an open spring 32 which urges the valve into closed position to permit normal water flow through channels 28*a*, 28*b* and 28*c*. When knob 18 is pulled out, spring 32 is compressed and valve 30 is then opened to permit water flow through 28, 28*a*, 28*b* and then through channel 28*d* into conduit 22. This permits the water to flow from channel 28*d* into tube 14 as shown in FIG. 3 and similarly into tube 14*a* mounted upon the opposite side of sleeve 15. The valve spring tension is designed to permit the valve to remain in open position under water pressure during water flow when the knob is pulled out and continue flow through the spray nozzles as long as desired. When this is no longer required, upon pushing the knob 18 in or upon shutting off the water, the spring will again urge the valve into closed position to permit normal flow through the faucet. "0" rings are provided at 29 to seal attachment to the faucet at 33 to seal the connection between conduit 22 and sleeve 15 and at 34 to seal the valve stem 18.

The exact opening of channel 28*d* is preferably provided with a restricted orifice 28*e* in order to effect a pressure drop in the water flow. For example, where a water pressure of 30 psi is present the diameter of 25*d* would be about 0.175–0.185 in. and the orifice diameter would be about half of that or about 0.08 in. to 0.09 in.

Figure 5:
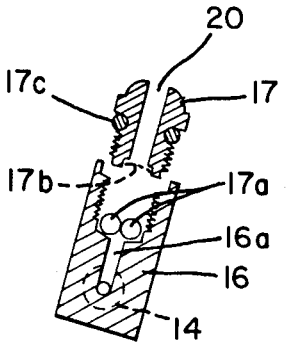
FIG. 5 is a view in vertical cross section of the tube and nozzle of FIG. 3, shown as a projection thereof.

As shown in FIG. 5, nozzle assembly 16 is shown in cross section with the connection to tube 14 shown in outline with the water flow through channel 16*a* engaging a pair of small diameter steel balls 17*a* which agitate and modify the water flow prior to exit through the tip of the nozzle 17. The steel balls are retained in position by a screen 17*b* which is positioned at the base of the nozzle orifice as shown and a space is provided between the base of the nozzle 17 and the recess in which the balls are retained and channel 16*a* to allow movement of the balls under water pressure to permit agitation. An O-ring 17*c* is provided in oder to seal the nozzle as shown in FIGS. 3 and 5. Nozzle opening may have a diameter approximately the diameter of conduit channel 28*d* or in the example described of about 0.18–0.19 in. Of course the dimensions of the channels and nozzles can be experimentally varied depending on water pressure and desired aspects of the spray produced.

The valve body and tubular attachments may be made of steel, brass, aluminum, zinc or suitable plastics, but preferably of stainless steel or chromium plated brass. As described above, this device with its two piece construction provides various advantages such as the ability to attach and utilize the eye wash arrangement only when and for so long as needed and to remove for cleaning or otherwise. In addition, the provision of a by-pass conduit as a component of the faucet attachment permits such conduit to be used for the attachment of other devices or other types of nozzles if so desired.

Other embodiments of the device as described above may be apparent to those skilled in the art without departing from the spirit and scope of my invention.

We claim:

1. An eye wash fountain for attachment to a water supply means such as a sink faucet or the like which comprises a valve body having a water inlet and a water outlet channel permitting normal water flow through said channels, a chamber between said channels, a water conduit connected to said chamber, a valve member positioned within said chamber which in closed position prevents water flow to said conduit and which in open position diverts water from said inlet channel to said conduit while preventing water flow to said outlet channel, said conduit extending rearward from said valve body when it is in attached position, an orifice within said conduit having a diameter sufficient to reduce pressure of water flowing from said conduit, a sleeve member closed at one end and open at the other having a spaced apart pair of tubes each tube having a nozzle attached thereto, each of said tubes being attached to and communicating with the interior of said sleeve member adjacent to said closed end, said sleeve member being slidably positioned and removably attached over said conduit and also extending rearward of said valve body, gasket means sealing the junction between said sleeve member and said conduit, said nozzles also being thereby positioned behind the said water supply means and extending at an upward and forward angle in order to direct a water spray to the eyes of a user when in front of said water supply means.

2. An eyewash fountain according to claim 1 wherein each of said nozzles is provided with a pair of loose metal balls retained adjacent to the nozzle exit, said balls being agitated during water flow to modify the nature of the water spray.

* * * * *